United States Patent [19]

Cucconi et al.

[11] Patent Number: 4,483,159

[45] Date of Patent: Nov. 20, 1984

[54] YARN FEEDING APPARATUS FOR MULTI-FALL KNITTING MACHINES

[75] Inventors: Enzo Cucconi; Renato Cucconi, both of Carpi, Italy

[73] Assignees: Savio & C. S.p.a., Milan; Cucconi Enzo & C. s.n.c., Carpi, both of Italy

[21] Appl. No.: 377,013

[22] Filed: May 11, 1982

[30] Foreign Application Priority Data

May 29, 1981 [IT] Italy ..... 40056 A/81
Oct. 23, 1981 [IT] Italy ..... 24661 A/81

[51] Int. Cl.[3] ..... D04B 15/48; D04B 15/54

[52] U.S. Cl. ..... 66/132 T

[58] Field of Search ..... 66/125 R, 132 T; 242/47.01, 47.04, 47.05, 47.12

[56] References Cited

U.S. PATENT DOCUMENTS 2,744,399 5/1956 West ..... 242/47.12 X
4,106,713 8/1978 Jacobsson ..... 242/47.01
4,147,311 4/1979 Jordan ..... 242/47.01

FOREIGN PATENT DOCUMENTS 1585298 10/1970 Fed. Rep. of Germany .... 66/132 T
1635893 5/1973 Fed. Rep. of Germany .... 66/132 T
3015191 11/1981 Fed. Rep. of Germany .... 66/132 T
1094854 12/1967 United Kingdom ..... 66/132 T
2065723 7/1981 United Kingdom ..... 66/132 T

*Primary Examiner*—Wm. Carter Reynolds
*Attorney, Agent, or Firm*—Oblon, Fisher, Spivak, McClelland & Maier

[57] ABSTRACT

Yarn feeding apparatus for knitting machines, particularly for circular knitting machines, including a rotatable roller or wheel, on which a belt operates and presses thereon a yarn passing on an eye carried by a yarn inserting arm and a yarn outlet arm, such arms being movable between a position for holding the yarn between the belt and roller or wheel, and a position at which the yarn is thereby held out of contact with the belt. The apparatus includes an eye, positioned between the belt and outlet arm, which is continuously laterally displaced relative to the belt, and on which the yarn let out from the apparatus passes before passing on the outlet arm. Thus, the time required for discontinuing the yarn supply by the involved apparatus is considerably shortened.

2 Claims, 4 Drawing Figures

YARN FEEDING APPARATUS FOR MULTI-FALL KNITTING MACHINES

BACKGROUND OF THE INVENTION

1. Field of the Invention

This invention relates to a yarn feeding apparatus for knitting machines, particularly for circular knitting machines.

2. Description of the Prior Art

As well known, in multi-fall knitting machines, that is to say in those machines wherein a knitted fabric is formed through needles drawing a plurality of feeding yarns from a plurality of cops or the like, such yarns are drawn from the cops and fed to the needles through feeding apparatuses, each comprising a roller or wheel freely rotable about its own axis and having a substantially cylindrical shaped surface, on which yarn can be pressed and held by a belt of lower height than that of the roller or wheel advanced by means of a drive member.

The belt advancement causes the roller or wheel to rotate and draws the yarn from the relative actuation cop, which yarn, when released from the belt and roller or wheel, is thus supplied to the respective needle at predetermined speed.

In case of circular knitting machines, rollers or wheels of this type are arranged according to a circle at the machine top and the belt rotably driving the same is single and loop closed.

The need often occurs to move the filaments of yarn out of the contact with the belt, displacing the involved yarn in the direction of the roller or wheel axis laterally of said belt. The yarn slips on the surface of the roller or wheel, which continues to be rotably driven by the belt, but with the latter no longer acting on the yarn. This occurs, for example, when the stitch length has to be changed on the knitting machine, or when the type of fabric being produced by the machine has to be changed, or again when a knitted fabric is produced having stripes of different colors and when desiring to leave out the filaments of yarn of a given colors from the fabric being formed.

Since knitting machines operate at high speed, when the necessity occurs of discontinuing the supply of a given yarn, steps must be taken for high speed removal of the involved yarn from the position at which such a yarn is pressed between the belt and relevant roller or wheel.

Each of the yarn feeding apparatuses are provided with a movable outlet arm for the passage thereon of the yarn moving out of the apparatus, and which is responsive to the outlet yarn tension. Loosening of the outlet yarn tension decreases the pressure on said arm, which mechanically or otherwise acts upon a yarn insertion arm or a guiding slit, which is lifted and moves the yarn away out the pressure zone of the belt on the roller or wheel. The movable outlet arm is somewhat longer than the yarn insertion arm, and the yarn passing over the involved roller or wheel passes on two eyes, one integral with each of the two arms. As the yarn is withdrawn, both of the arms are displaced to the belt, so as to hold the yarn under the belt at a position substantially longitudinally of the belt. When the supply of the involved yarn has to be discontinued, displacement of the two arms draws the yarn out of the contact with the belt and relevant roller or wheel.

Feeding apparatuses of this type are well known and described, for example in the German Pat. No. 1,585,298 corresponding to U.S. Pat. No. 3,264,845 and in the published German Pat. application No. DOS 1,635,893, but have the disadvantage of requiring a relatively extended period of time between the time at which the movable outlet arm acts upon the movable inlet arm shifting the yarn laterally of the belt: such a time is determined by the required time that, following the side displacement of the inlet arm relative to the belt, the whole length of yarn, which is pressed between the belt and roller or wheel in parallel relationship to the belt, is withdrawn away from below the belt. In other words, for withdrawing the yarn away from the zone of contact between the belt and roller or wheel, the latter should rotate through an angle equal to the maximum angle according to which the contact between the belt and roller or wheel would occur.

Additionally, during the yarn feed the outlet arm takes a position that is determined by an outlet eye integral with such arm and by a location where the yarn leaves that zone at which it is pressed between the belt and roller or wheel. As a result, when the outlet arm is moved or driven to control arresting of the yarn feed, it is pulled towards the belt by the yarn which is substantially at an intermediate position to the belt. This implies that the movement of the outlet arm is considerably hindered.

Along with the above mentioned factor, this factor means that a relatively extended time is required between the time at which the arrest signal for the supply of a yarn is given and the time at which such a supply effectively ceases, which makes the apparatus unusable when the yarn insertion and/or disconnection has to be rapidly carried out.

SUMMARY OF THE INVENTION

It is the primary object of the present invention to provide an improved yarn feeding apparatus, wherein the time for discontinuing the yarn feed is very short.

It is another object of the invention to provide an apparatus of the above mentioned type, which is of very simple structure and low in terms of cost production.

These and still other objects are achieved by a yarn feeding apparatus for knitting machines comprising a roller or wheel freely rotably mounted on a rigid support which can be secured on a machine and having a plurality of spokes distributed on a cylindrical surface coaxial with said roller or wheel and on a surface arc of which a belt can be seated, the height of this belt being less than the height of said spokes, two rocking arms being mounted on said rigid support and having eyes for the yarn passage, a yarn inlet arm being adjacent to that zone at which said belt comes in contact with said roller or wheel, and a yarn outlet arm being adjacent to that zone at which said belt separates or moves away from said roller or wheel, such arms being rockable between a position, at which the respective eye is moved at the level of said belt, and a position at which said eye is displaced laterally of the belt, characterized in that at that side where the yarn outlet arm is provided, in close proximity to the roller or wheel, an outlet eye is provided for the passage therein of the yarn that has passed on the roller or wheel, such outlet eye always being displaced laterally of said belt at any operating condition of the apparatus.

BRIEF DESCRIPTION OF THE DRAWINGS

In order that the structure and features of the yarn feeding apparatus according to the invention be more clearly understood, two embodiments thereof will now be described as given by mere way of unrestrictive example, with reference to the accompanying drawings, in which.

DETAILED DESCRIPTION OF THE PREFERRED EMBODIMENTS

Referring first to FIGS. 1 to 4, in which a yarn feeding apparatus for knitting machines is shown as comprising a rigid support or casing 1, on which a roller or wheel 2 is mounted so as to be freely rotable about its own axis, the periphery of this roller or wheel 2 being defined by a plurality of metal spokes 3 distributed in a cylindrical array.

Figure 1:
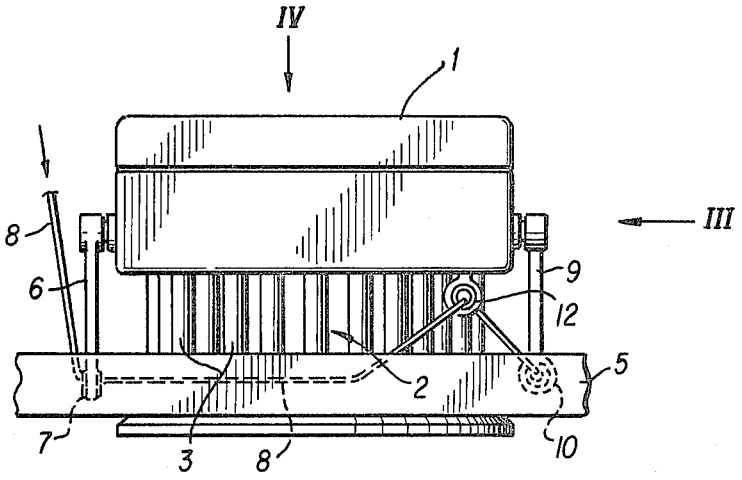
FIG. 1 is a front elevational view showing an apparatus in accordance with the present invention with a fixed outlet eye, the apparatus being shown at operating conditions, when it draws the yarn to be supplied to the needles of the knitting machine.
Figure 2:
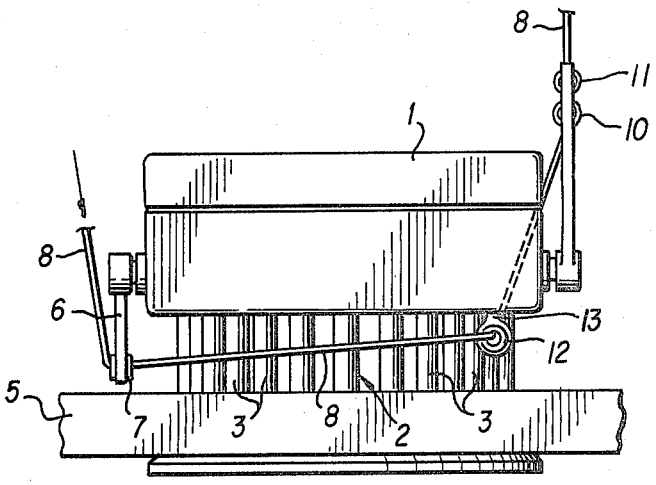
FIG. 2 is a view fully similar to that of FIG. 1, but showing the apparatus in an inoperative condition, that is in a condition in which it does not withdraw any yarn and does not supply it to the needles of the knitting machine.
Figure 3:
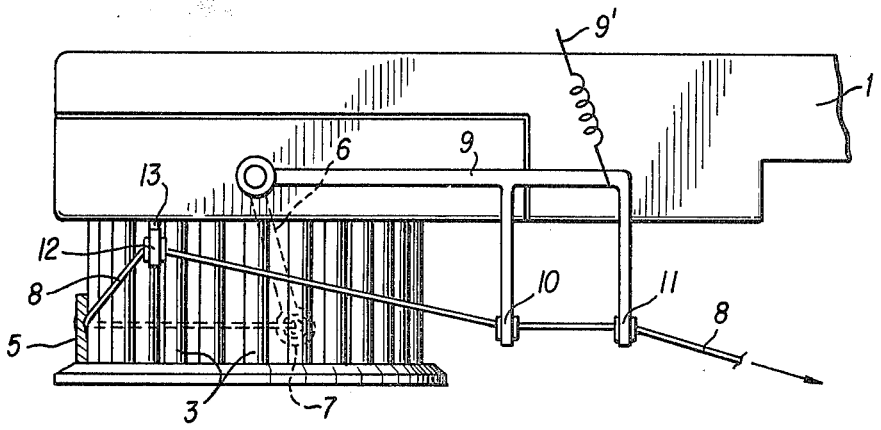
FIG. 3 is a side elevational view of the apparatus, according to arrow III of FIG. 1.

A sectional arc of the cylindrical zone defined by said spokes 3 bears a closed continuous tape belt 5 (FIG. 4), the height of which is considerably less than the length of spokes 3, as will be seen from FIGS. 1 to 3. When the roller or wheel 2 is rotating, the belt 5 also rotates without contacting on the roller or wheel.

The apparatus casing 1 rockably mounted on a horizontal pin (as seen in FIGS. 1 to 3) a supply or inlet arm 6 having an eye 7, comprising for example a small ring of ceramic material, in which the yarn 8 from a cop (not shown) or other similar body passes and slides. The supply or inlet arm 6 is oscillable between two positions at the end of a stroke, at one of which the eye 7 is at a lower level than the upper edge of the belt 5, and at the other position of which such eye is displaced laterally of the belt. At the first position (FIG. 1) the apparatus is operating, while at the second position it is inoperative or out of service. Additionally, it should be reminded that it is not strictly necessary that the working position the eye 7 is lower than the upper edge of the belt or tape 5, since expedients are also provided, such as fixed or adjustable rods inclined towards the belt, on which the yarn 8 grazes for being moved to a lower level than the upper edge of the belt, even if said eye 7 remains in a raised condition relative to said upper edge. Such structure is per se known and is disclosed both in the German Pat. No. 1,585,298 and in the published German patent application No. DOS 1,635,893.

Still, on said casing 1 an oscillating outlet arm 9 is mounted, also rotable about a horizontal axis with respect to FIGS. 1 to 3, which arm 9 is connected to inlet arm 6 and carries eyes (also usually housing small rings of ceramic material), respectively designated by reference numerals 10 and 11, having passing therethrough the yarn 8 from the eye 7.

Figure 4:
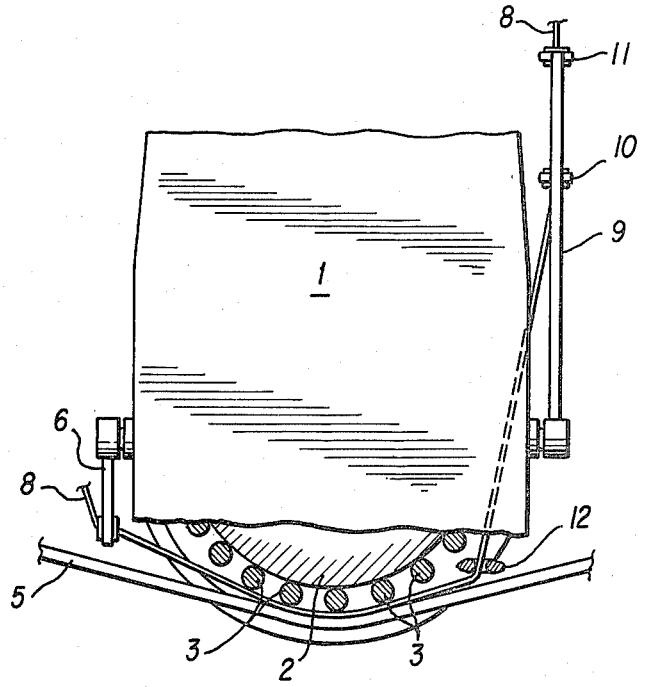
FIG. 4 is a fragmentary top view of said apparatus, according to arrow IV of FIG. 1.

The function of said outlet arm 9 will not be herein further described, due to being per se well known. It will suffice to note that such an arm is retained at a lowered position, shown in FIGS. 1 to 3, by the yarn 8 maintained under tension during its withdrawal by the needles of the knitting machine. When such tension is loosened (for example, because the yarn is no longer withdrawn by the relative needles, or because it is broken), the outlet arm 9 is automatically upwardly lifted by a spring 9, and causes the inlet arm 6 to be lifted from the operative position of FIG. 1 to the inoperative position of FIG. 2. This is done in order to move the yarn 8 out of the zone of contact between the belt or tape 5 and the surface portion of the spokes 3 on which said belt is pressed, holding and drawing the yarn when it is at the lowered position. (FIGS. 1, 3 and 4).

The structure of the apparatus hitherto described is well known and accordingly no further details are required for showing the operation thereof.

However, it should be pointed out that a problem of outstanding importance is that of allowing the fastest passage of the yarn from the drawing position of FIG. 1 to the inoperative position of FIG. 2, in order to avoid to continue to draw and supply the yarn to the needles when the latter either do not any longer withdraw yarn, or withdraw yarn in a lower amount.

To this end, according to the invention, a fixed outlet eye 12 is provided on the apparatus and through a small bracket 13 is integral with the apparatus casing 1. As clearly shown in FIGS. 1 to 4, said eye 12 is positioned in close proximity to the roller or wheel 2 and is laterally displaced (that is above, as seen in FIGS. 1 to 3) relative to the belt 5. As a result, after passing through the eye 7, the yarn 8 passes into the eye 12 before passing into the eyes 10 and 11 of the yarn outlet arm.

Owing to the position of the fixed eye 12, at the operative conditions (FIGS. 1 and 3), the yarn 8, which is pressed by the belt 5 against the spokes 3, does not have a fully horizontal attitude throughout along the zone of contact of the belt with the adjacent spokes. Instead said fixed eye 12 acts on the yarn by upwardly withdrawing it (and thus tending to move it out of the contact by said belt 5) at the zone where the belt is still pressed on the spokes 3 of the roller or wheel 2, as clearly shown in FIG. 1. First, this causes the length of the yarn pressed between the belt or tape 5 and spokes 3 to be less than the length or extension of the arc comprising the actual zone of contact of the belt on the spokes.

Moreover, the provision of said fixed eye 12 enables an easier and faster upward rotation of the outlet arm 9 where the yarn outletting from the apparatus should undergo a decrease in tension.

This is caused in that the fixed eye 12 moves to a higher level, that is closer to the pivot pin of the outlet arm 9 the location from which the yarn arrives that is directed to the eyes 10 and 11 of said arm. Thus, in the absence of said fixed eye 12, during the yarn feed, said yarn would be taut between the belt 5 and eye 10, and accordingly the distance or spacing would be larger between the pivot pin of arm 9 and yarn, which would constitute an increased brake against the upward movement of the arm.

The result is that due to the two above mentioned factors the provision of said eye 12 at the position described with reference to FIGS. 1 to 4 causes a high increase in sensitivity and reaction speed of the apparatus as the outlet yarn tension varies, and enables setting the yarn out of service much more rapidly than obtainable by similar apparatuses of known type, but without the above described fixed eye 12.

From the foregoing it will be readily understood that the structure of the improved yarn feeding apparatus according to the present invention is extremely simple and modifications are easily made to the existing similar apparatuses of known type. Also the utilization of the apparatus does not present any kind of problem, as it is exactly used as the known apparatuses presently on commerce.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A yarn feeding apparatus for a knitting machine utilizing a belt and having a rigid support, comprising:

means freely rotatably mounted on said rigid support;

a plurality of spokes distributed in a cylindrical array, coaxial with said freely rotatable means and on a surface arc of which said belt is seated, the height of the belt being less than the height of said spokes;

first and second rocking arms mounted on said rigid support and having eyes for the passage of yarn therethrough wherein said first arm further comprises a yarn inlet arm located adjacent a zone at which said belt comes in contact with said spokes and said second arm further comprises a yarn outlet arm located adjacent a zone at which said belt separates from said spokes;

means for oscillating said first and second arms between a position where each respective eye is displaced at the level of said belt, and a position wherein each of said eyes is displaced laterally of said belt; and a bracket connected to said support in close proximity to said freely rotatable means, said bracket including an outlet eye through which the yarn passes after passing said freely rotatable means, said outlet eye of said bracket being continuously displaced laterally with respect to said belt under all operating conditions of said apparatus.

2. A yarn feeding apparatus according to claim 1, wherein said bracket and bracket outlet eye are integral with said rigid support.

* * * * *